US011805869B2

(12) United States Patent
Wang et al.

(10) Patent No.: US 11,805,869 B2
(45) Date of Patent: Nov. 7, 2023

(54) UMBRELLA HAVING INDEPENDENT HANDLE MECHANISM

(71) Applicant: Linhai Meiyang Parasol Industry Co., Ltd, Zhejiang (CN)

(72) Inventors: Yingying Wang, Zhejiang (CN); Yuefu Ke, Zhejiang (CN)

(73) Assignee: Linhai Meiyang Parasol Industry Co., Ltd, Zhejiang (CN)

( * ) Notice: Subject to any disclaimer, the term of this patent is extended or adjusted under 35 U.S.C. 154(b) by 201 days.

(21) Appl. No.: 17/422,755

(22) PCT Filed: May 18, 2021

(86) PCT No.: PCT/CN2021/094271

§ 371 (c)(1),
(2) Date: Jul. 14, 2021

(87) PCT Pub. No.: WO2022/227130

PCT Pub. Date: Nov. 3, 2022

(65) Prior Publication Data

US 2022/0346510 A1 Nov. 3, 2022

(30) Foreign Application Priority Data

Apr. 30, 2021 (CN) ..... 202120932095.6

(51) Int. Cl.
*A45B 25/02* (2006.01)
*A45B 25/00* (2006.01)

(52) U.S. Cl.
CPC ..... *A45B 25/02* (2013.01); *A45B 2025/003* (2013.01)

(58) Field of Classification Search
CPC ..... A45B 2023/0037; A45B 2023/005; A45B 2025/146
See application file for complete search history.

(56) References Cited

U.S. PATENT DOCUMENTS 7,886,755 B2 * 2/2011 Tung ..... A45B 25/14 135/21
8,104,492 B2 * 1/2012 Dan ..... A45B 25/14 135/21
10,136,709 B2 * 11/2018 Ma ..... A45B 23/00

* cited by examiner

*Primary Examiner* — Noah Chandler Hawk
(74) *Attorney, Agent, or Firm* — JCIPRNET

(57) ABSTRACT

An umbrella includes an umbrella column having a top portion hingedly fitted with one end of a connecting rod, and the other end of the connecting rod is hingedly fitted with a pull rod. One side of the umbrella column has a chute, an armrest shell is slidably fitted in the chute, one end of the pull rod is hingedly fitted with an upper umbrella tray, and the other end of the pull rod is fixedly connected to a handle base. The rope reel set is used to wind an umbrella rope, and extends into an umbrella tray assembly along the pull rod. The handle base is hingedly fitted with the armrest shell located at an inner side of the umbrella column and provided for fitting with the chute. The armrest shell is movably positioned along the chute.

7 Claims, 10 Drawing Sheets

UMBRELLA HAVING INDEPENDENT HANDLE MECHANISM

CROSS-REFERENCE TO RELATED APPLICATION

This application is a 371 of international application of PCT application serial no. PCT/CN2021/094271, filed on May 18, 2021 which claims priority to and the benefit of China Patent Application No. 202120932095.6, filed on Apr. 30, 2021. The entirety of each of the above-mentioned patent applications is hereby incorporated by reference herein and made a part of this specification.

BACKGROUND

Technical Field

The invention relates to the technical field of Roman umbrellas, and in particular to an umbrella having an independent handle mechanism.

Description of Related Art

Roman umbrella is the most powerful outdoor parasol, which can be rotated one circle in the horizontal direction or tilt 90 degrees in the vertical direction. Shading with a Roman umbrella is the most creative and leisure way in Chinese market. The area under the umbrella is wide, and outdoor furniture can be placed casually. The umbrella cover can be rotated freely, which can block the sunlight at will. Compared with other umbrellas, Roman umbrellas have better shading effect and more convenient operation.

The Roman umbrella is controlled to rotate and lift through the armrest shell. The structure and quality of the armrest shell are very important to the use of the Roman umbrella. In actual use, the armrest shell will have unstable connection, which will cause the umbrella stand Roman umbrella to shrink after being opened for a period of time, affecting actual use. In addition, the hand lever parts of the traditional armrest shell are all on the outside of the umbrella body, and it is necessary to stand outside the umbrella for adjustment. And it is inconvenient to move the armrest shell in rainy or sunny weather, for example.

SUMMARY

In order to overcome the shortcomings of the prior art, the present invention provides a umbrella having a simple armrest shell structure, stable connection and an independent handle mechanism.

The umbrella having an independent handle mechanism includes an umbrella column. A top portion of the umbrella column is hinged with one end of a connecting rod, and the other end of the connecting rod is hinged with a pull rod. One side of the umbrella column is provided with a chute, an armrest shell is slidably fitted in the chute, one end of the pull rod is hingedly fitted with an upper umbrella tray, and the other end of the pull rod is fixedly connected to a handle base. The handle base comprises a pull rod receiving end and a rope reel mounting end, and a rope reel set is provided in the rope reel mounting end for fitting. The rope reel set is used to wind an umbrella rope, and extends into an umbrella tray assembly along the pull rod, so as to realize opening and closing of the umbrella tray assembly. The handle base is hingedly fitted with the armrest shell, the armrest shell is located at an inner side of the umbrella column and is provided for fitting with the chute in an inner side wall of the umbrella column; and the armrest shell is vertically movably positioned along the chute.

Preferably, the rope reel set is provided with a first rope guide roller and a second rope guide roller, the first rope guide roller and the second rope guide roller are located at or near both ends of the pull rod, and the umbrella rope extends from the rope reel set to the first rope guide roller and the second rope guide roller sequentially, and extends outward into the umbrella tray assembly through an umbrella rope outlet.

Preferably, the umbrella rope extends along an inner cavity of the pull rod to the umbrella tray assembly.

Preferably, rope holes are provided above both ends of the pull rod, and a rope slot is provided at a top portion of the pull rod. After the umbrella rope passes through the rope holes, the umbrella rope extends through the rope slot to an end rope hole connected to the umbrella tray, and extends into the umbrella tray assembly through the second rope guide roller.

Preferably, an end portion of the pull rod is embedded into an inner end of the pull rod receiving end, and is fixedly mounted by a bolt piece. The first rope guide roller is rotatably mounted on the bolt piece.

Preferably, an end portion of the pull rod is provided with a rope guide roller end seat, and a bolt piece and the second rope guide roller pass through the rope guide roller end seat.

Preferably, an inner end of the rope reel mounting end is provided with a rope reel, and the rope reel is connected to the armrest shell through a rotating shaft.

Preferably, the armrest shell is provided with a trigger, and a lower end of the trigger is provided with a thimble for fitting.

Preferably, an upper end of the trigger is provided with a clamping piece, and the clamping piece is connected to the fixing pin provided on the armrest shell.

Compared with the prior art, the present invention has the following advantages.

With the armrest shell of the present invention, after the umbrella body is opened, the position of the armrest shell can be adjusted under the umbrella cover, and the angle of the umbrella cover of the umbrella can be adjusted by moving the armrest shell up and down. By pressing the trigger, the umbrella can be locked or unlocked quickly, which is convenient for the adjustment of the armrest shell. After locking, the thimble tightly abuts against the chute, which has strong connection stability. And rollers convenient for sliding are provided on both sides of the embedded strip of the armrest shell.

DESCRIPTION OF THE EMBODIMENTS

Figure 1:
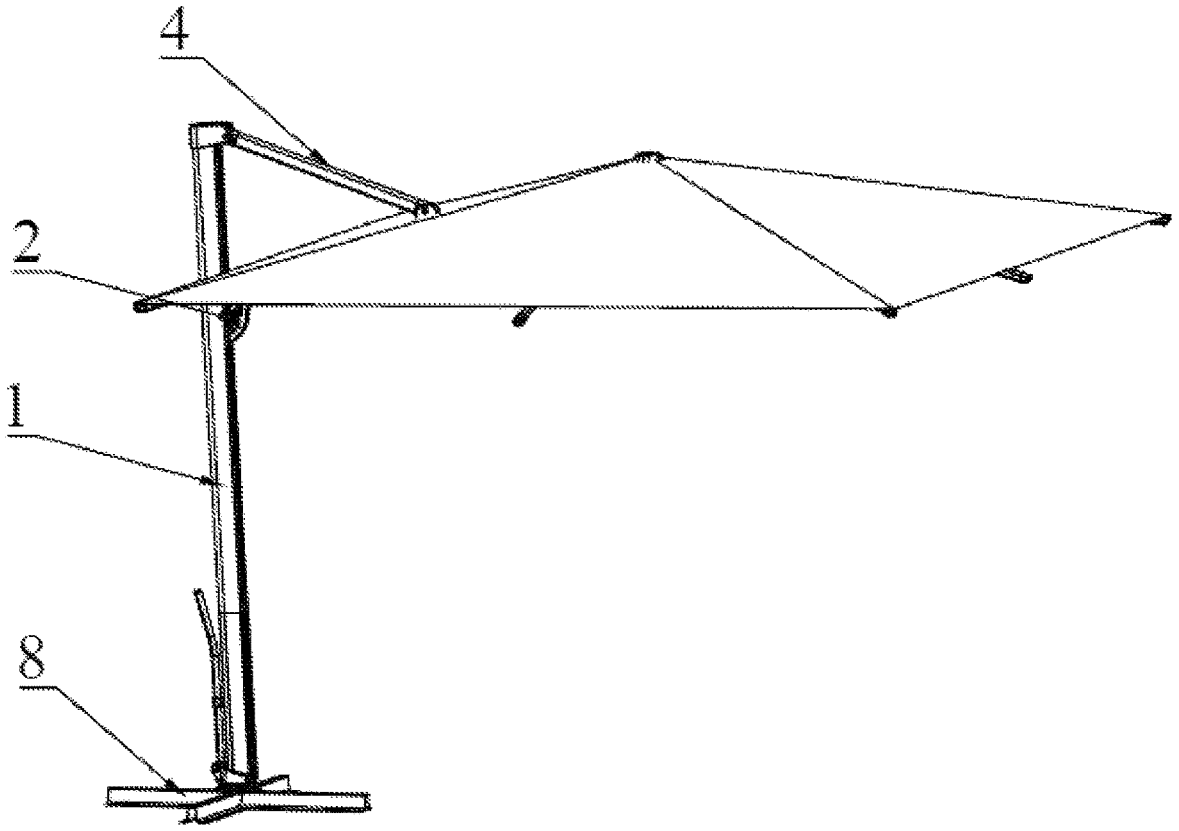
FIG. 1 is a schematic structural diagram of a Roman umbrella according to the present invention.
Figure 2:
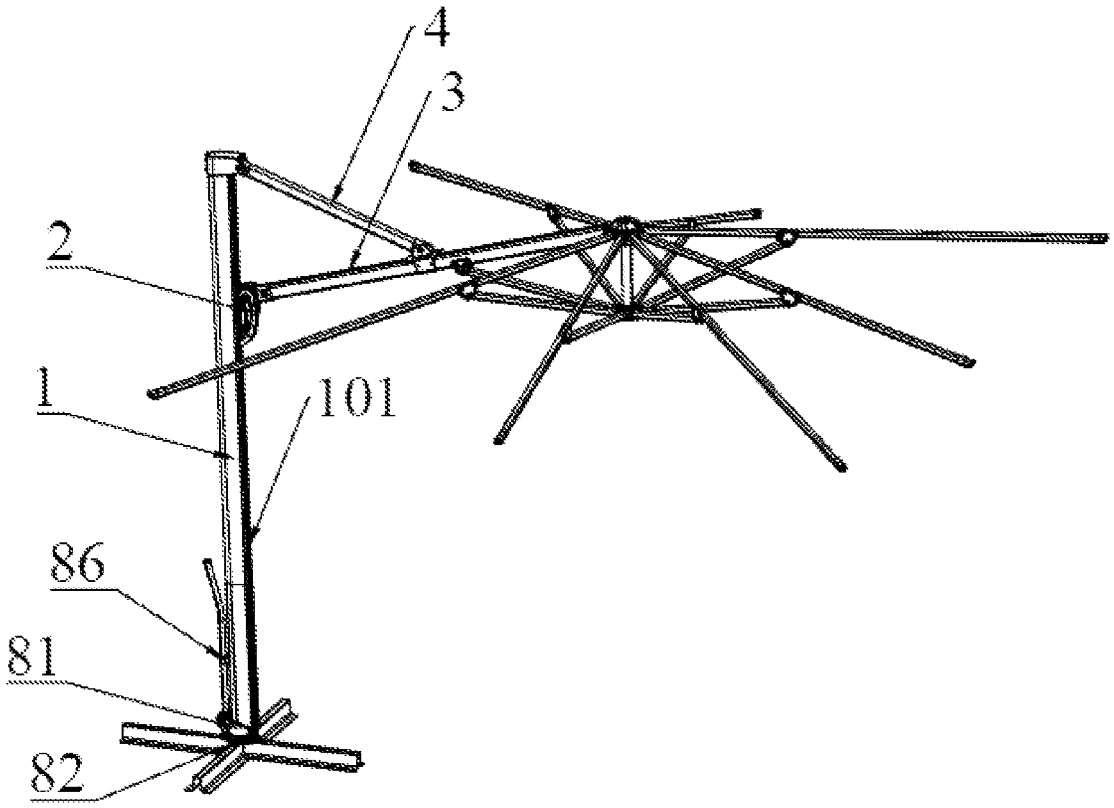
FIG. 2 is a schematic diagram of a connecting structure of an umbrella rod of the Roman umbrella according to the present invention.
Figure 3A:
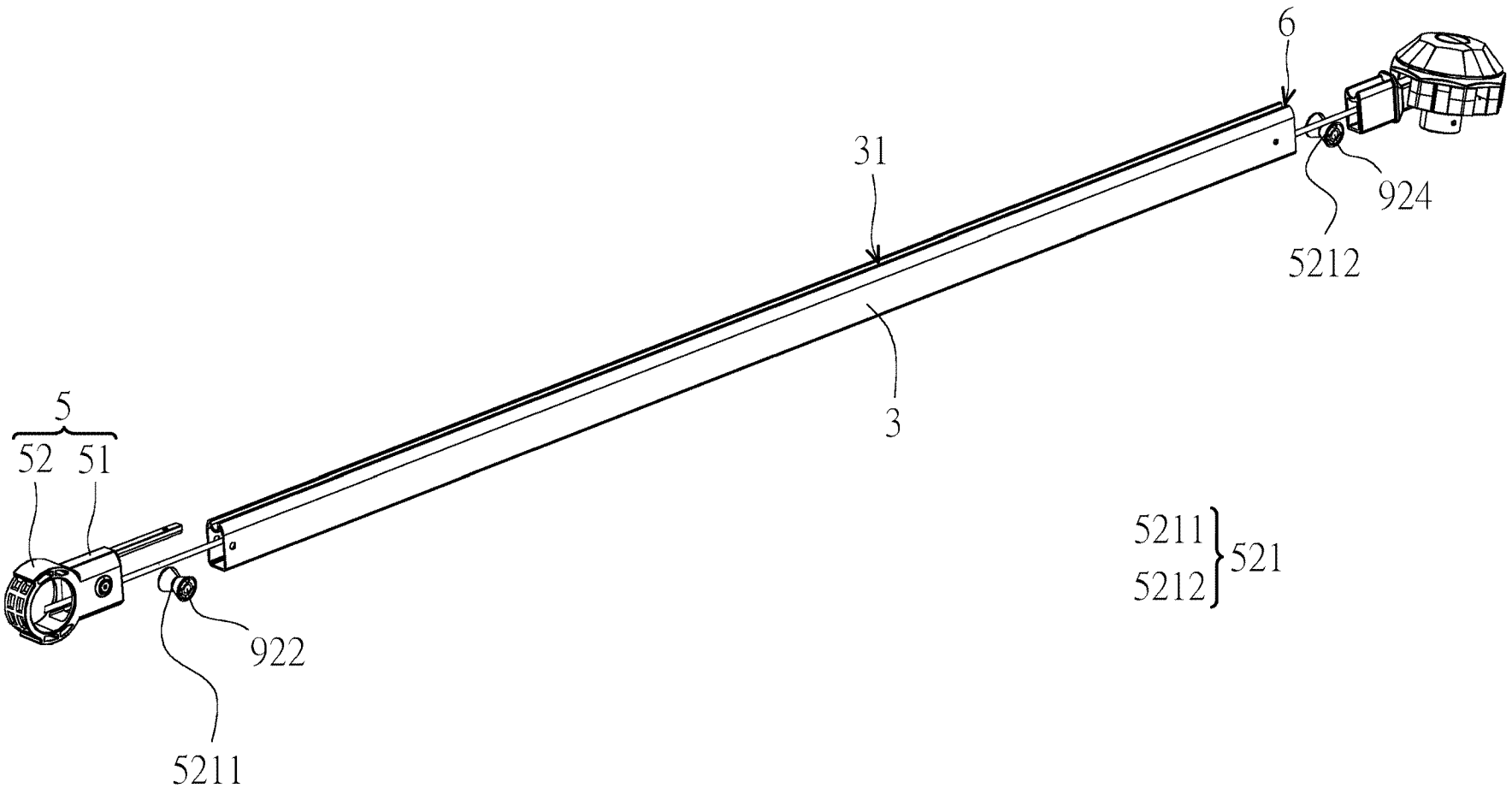
FIG. 3 is a structural schematic diagram of an armrest shell and a pull rod of a Roman umbrella according to the present invention.
Figure 3B:
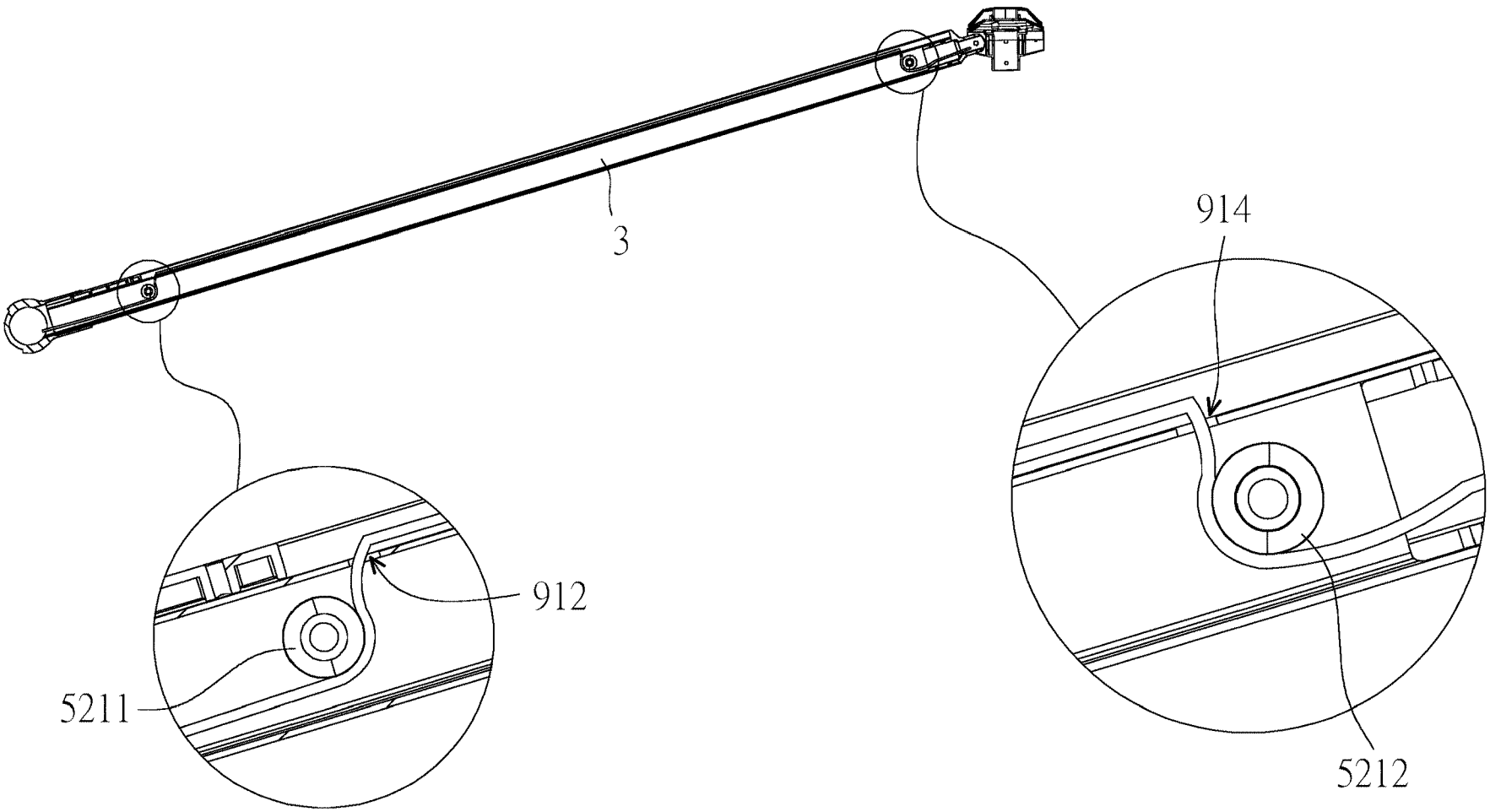
Figure 4:
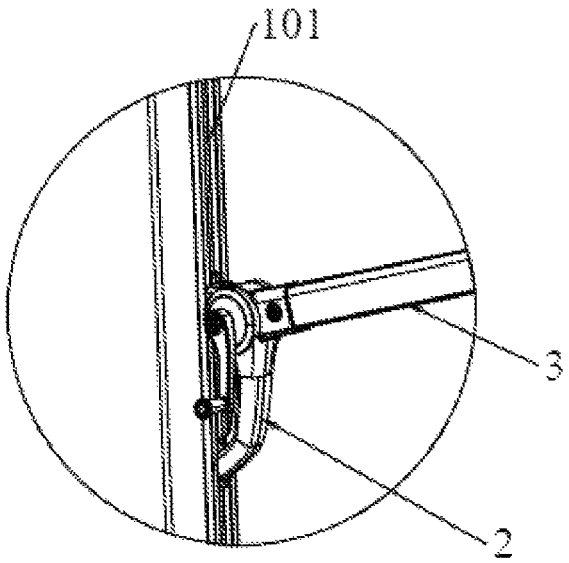
FIG. 4 is a schematic diagram of the mounting of the armrest shell.
Figure 5:
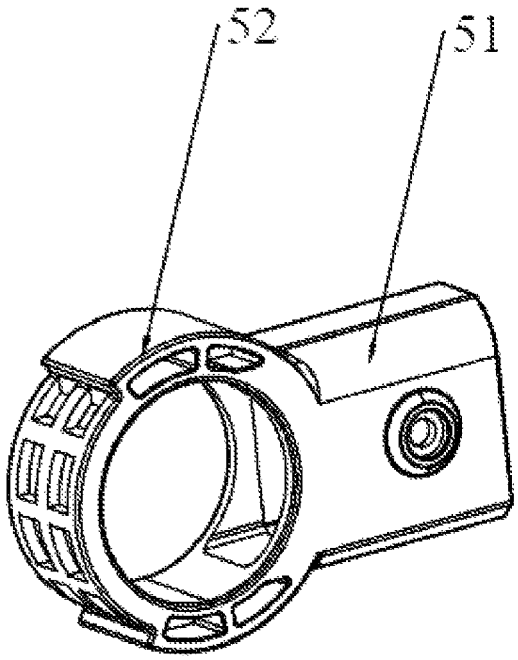
FIG. 5 is a schematic diagram of a handle base.
Figure 6:
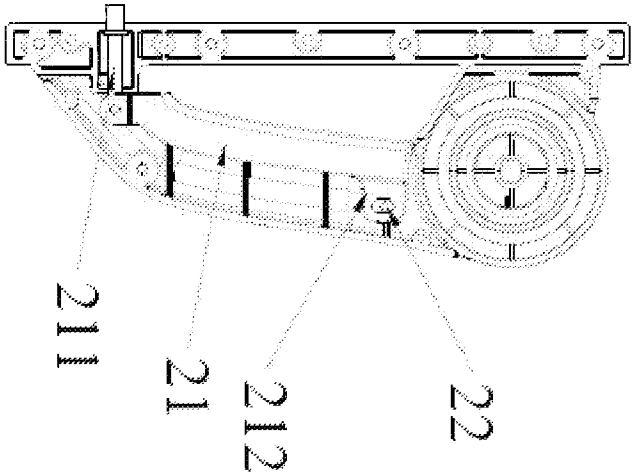
FIG. 6 is a schematic diagram of the internal structure of the armrest shell.
Figure 7:
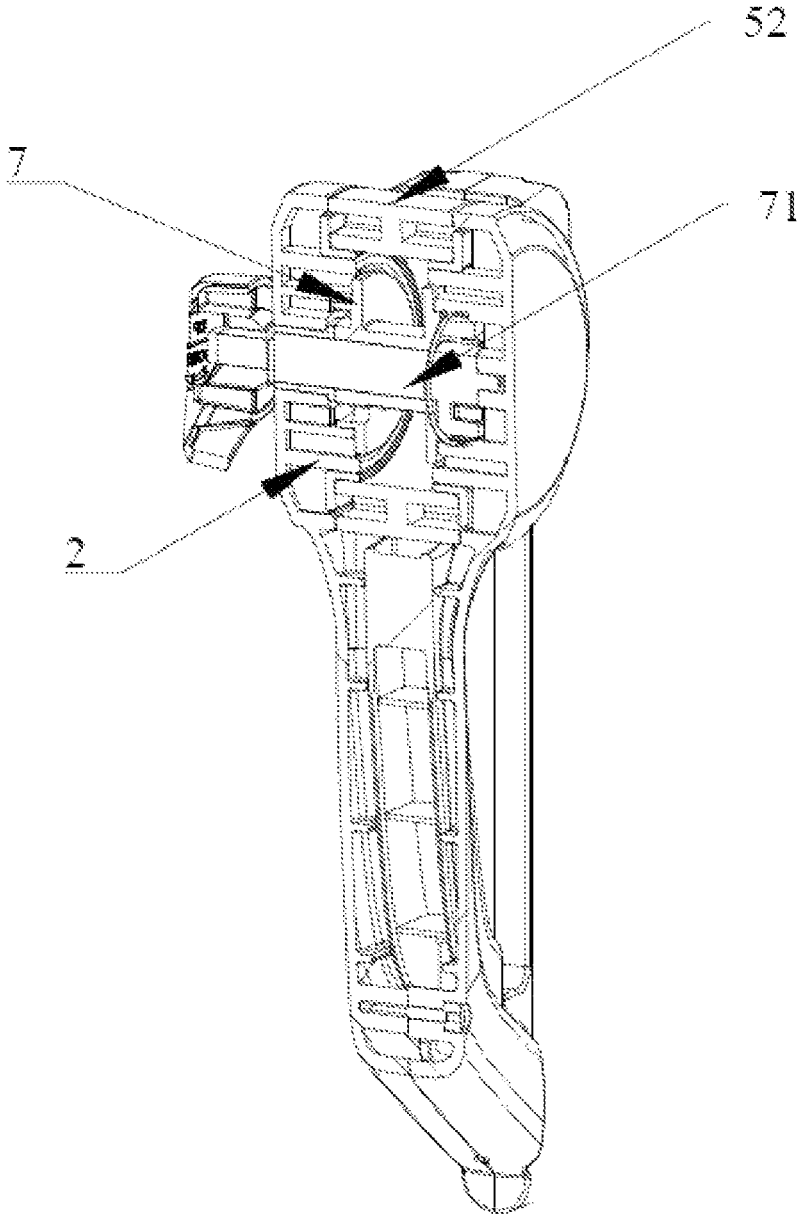
FIG. 7 is a schematic diagram of the connection between the handle base and the armrest shell.

In the description of the present invention, it should be understood that the terms "one end", "the other end", "outer", "upper", "inner", "horizontal", "coaxial", "central", "end portion", "length", "outer end" and the like indicate the orientations or positional relationships based on the orientations or positional relationships shown in the drawings, and are only for the convenience of describing the present invention and simplifying the description, rather than indicating or implying the described device or element must have a specific orientation, be constructed and operated in a specific orientation, and therefore cannot be understood as limiting the present invention.

The present invention will be further described below with reference to the drawings.

As shown in FIGS. 1-7, a Roman umbrella with an independent handle mechanism comprises an umbrella column 1. A top portion of the umbrella column 1 is hinged with one end of a connecting rod 4, and the other end of the connecting rod 4 is hinged with a pull rod 3. One side of the umbrella column 1 is provided with a chute 101, an armrest shell 2 is slidably fitted in the chute 101, one end of the pull rod 3 is hingedly fitted with an upper umbrella tray, and the other end of the pull rod 3 is fixedly connected to a handle base 5. The handle base 5 comprises a pull rod receiving end 51 and a rope reel mounting end 52, and a rope reel set 521 is provided in the rope reel mounting end 52 for fitting. The rope reel set 521 is used to wind an umbrella rope, and extends into an umbrella tray assembly along the pull rod, so as to realize opening and closing of the umbrella tray assembly. The handle base 5 is hingedly fitted with the armrest shell 2, the armrest shell 2 is located at an inner side of the umbrella column 1 and is provided for fitting with the chute 101 in an inner side wall of the umbrella column, and the armrest shell 2 is vertically movably positioned along the chute 101.

The rope reel set 521 is provided with a first rope guide roller 5211 and a second rope guide roller 5212, the first rope guide roller 5211 and the second rope guide roller 5212 are located at or near both ends of the pull rod, and the umbrella rope extends from the rope reel set 521 to the first rope guide roller 5211 and the second rope guide roller 5212 sequentially, and extends outward into the umbrella tray assembly through an umbrella rope outlet.

The umbrella rope extends along an inner cavity of the pull rod to the umbrella tray assembly. Or, rope holes 912 and 914 are provided above both ends of the pull rod 3, and a rope slot 31 is provided at a top portion of the pull rod 3. After the umbrella rope passes through the rope hole 912, the umbrella rope extends through the rope slot 31 to an end rope hole 914 connected to the umbrella tray, and extends into the umbrella tray assembly through the second rope guide roller 5212.

An end portion of the pull rod 3 is embedded into an inner end of the pull rod receiving end 51, and is fixedly mounted by a bolt piece 922. The first rope guide roller 5211 is rotatably mounted on the bolt piece 922.

The end portion of the pull rod 3 is provided with a rope guide roller end seat 6, and a bolt piece 924 and the second rope guide roller 5212 pass through the rope guide roller end seat 6.

An inner end of the rope reel mounting end 52 is provided with a rope reel 7, and the rope reel 7 is connected to the armrest shell 2 through a rotating shaft 71.

The locking mechanism includes a trigger 21, and a lower end of the trigger 21 is provided with a thimble 211 for fitting. An upper end of the trigger 21 is provided with a clamping piece 212, and the clamping piece 212 is connected to the fixing pin 22 provided on the armrest shell 2.

When the trigger is pulled, the positioning pin 11 is clamped at different positions in the travel slot of the clamping piece, and the thimble at the bottom portion of the trigger is pushed out or retracted. The thimble 211 is also provided with a retaining ring to prevent the thimble 211 from rushing out of the embedded strip, which may cause the armrest shell to be unable to adjust.

Rollers are provided on both sides of the embedded strip, and the armrest shell may move up and down in the chute 101 through the rollers. The side of the embedded strip opposite to the chute 101 is provided with a limiting piece, which is usually a limiting hole or a limiting rack, which facilitates the locking between the thimble 211 and the limiting hole or the limiting rack, and the thimble 211 is ejected or retracted into the shell to fix the armrest shell 2.

A rotating shaft 71 is provided in the middle of the armrest shell 2, and a hand lever 72 is provided on the rotating shaft 71. The rotating shaft 71 is rotatably arranged in the armrest shell 2, and one end of the rotating shaft 71 penetrates through the armrest shell to be fitted with the hand lever 72. The rotating shaft is connected to the rope reel 7 in the handle base 5 to drive the rope reel to rotate.

The pull rod 3 is provided with umbrella trays including an upper umbrella tray and a lower umbrella tray, and a connecting column is provided between the upper umbrella tray and the lower umbrella tray. An upper hinge seat and a lower hinge seat are respectively fixedly provided at end portions of the connecting column, the long umbrella rod of the upper umbrella tray is hinged on the upper hinge tray, one end of the short umbrella rod of the lower umbrella tray is hinged on the lower hinge tray, and the other end of the short umbrella rod is hinged on the long umbrella rod 51 through a hinge.

Figure 8:
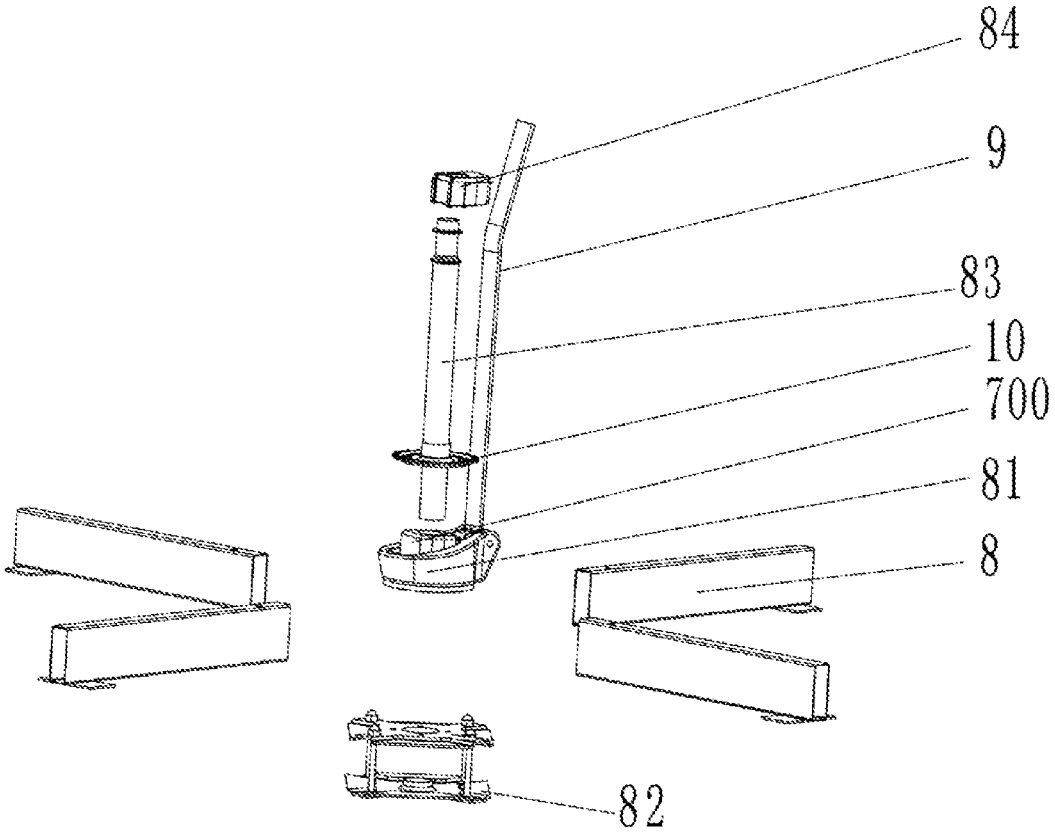
FIG. 8 is a schematic diagram of an exploded structure of a bearing seat and other components in the pedestal.
Figure 9:
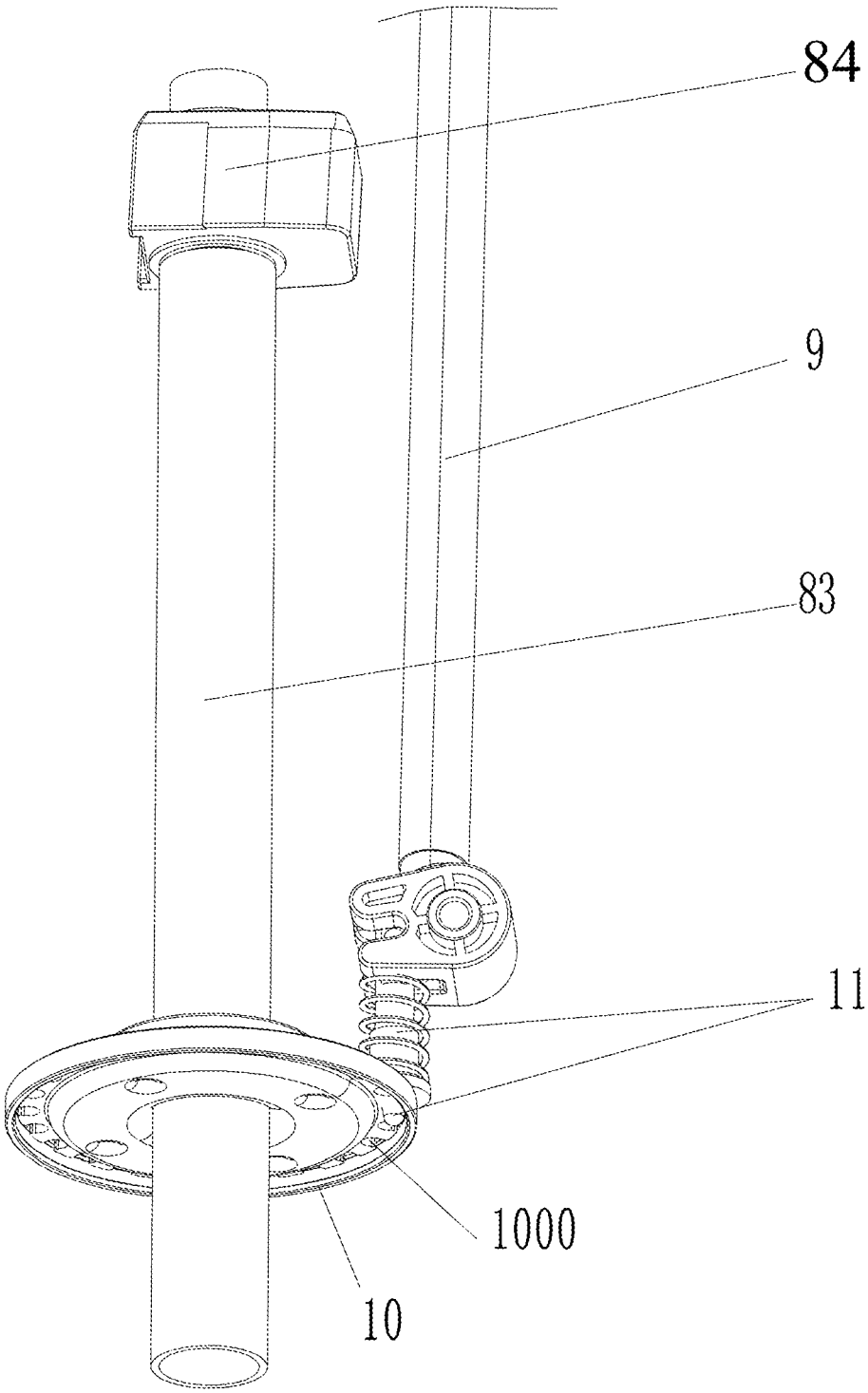
FIG. 9 is a schematic diagram of a connection structure between a locking ring and a wrench.
Figure 10:
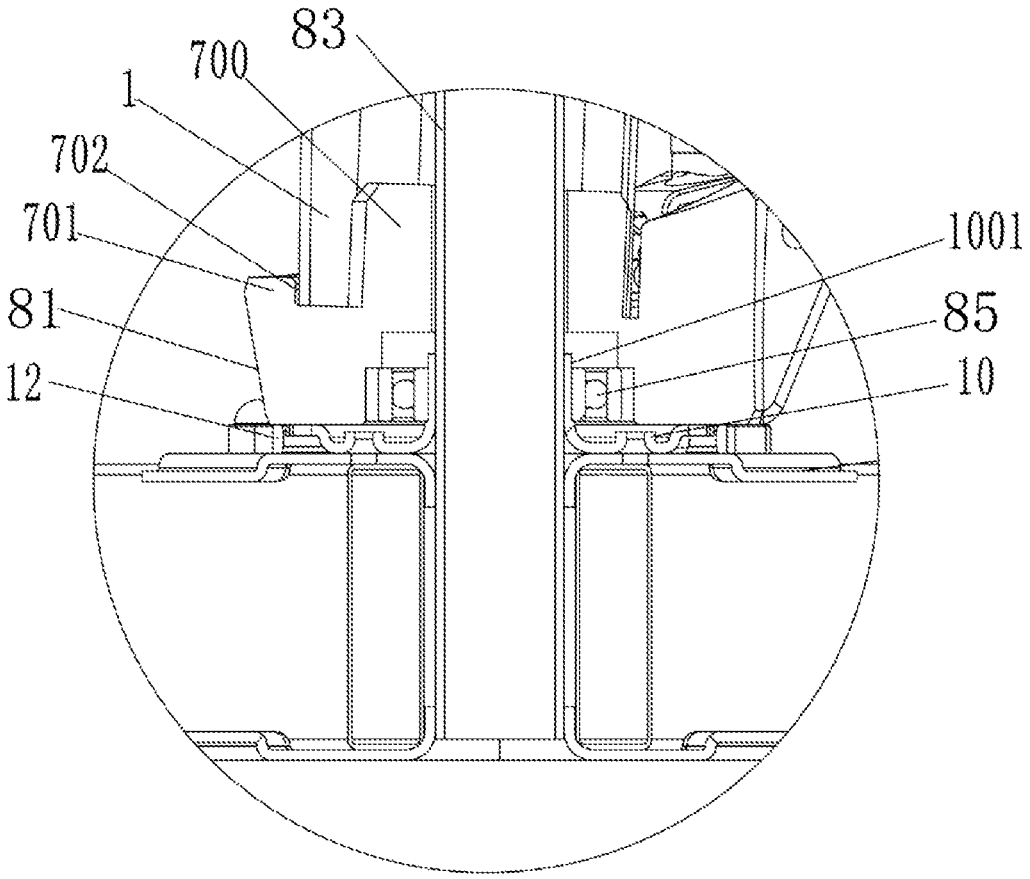
FIG. 10 is a schematic diagram of an assembly structure of the pedestal and the umbrella column.

With reference to FIGS. 8-10, the bottom portion of the umbrella column 1 is provided with a pedestal 8, which is provided with a bearing seat 81 and a first positioning block 700. The bottom portion of the umbrella column 1 is inserted into the first positioning block 700 from the outside, and the first positioning block 700 is transmissively coupled to the umbrella column 1. A supporting column 83 is provided in the pedestal 8, and the umbrella column 1 is pivotally sleeved outside the supporting column 83.

The edge of the bearing seat 81 is provided with a ring of positioning edge 701, and a positioning groove 702 is formed between the positioning edge 701 and the first positioning block 700, and the bottom portion of the umbrella column 1 is inserted into the positioning groove 702.

The upper end of the supporting column 83 is rotatably provided with a second positioning block 84, which is located in the umbrella column 1 and is transmissively coupled to the umbrella column 1.

A wrench 9 is provided on one side of the bearing seat 81, and a locking ring 10 is fixedly sleeved on the supporting column 83, a plurality of locking grooves 1000 are distributed on the locking ring 10. The locating pin 11 is used for inserting into the locking groove 1000, the locking ring 10 is sleeved in a sealing ring 12, a bearing 85 is provided in the bearing seat 81, and the umbrella column 1 is provided with a buckle 86 for fixing the clamping wrench 9. The bearing seat is fixedly mounted on the pedestal through the mounting base 82.

The locating pin 11 is connected to the lower end of the wrench 9 through a pin and is urged by a spring.

The locking ring 10 is sleeved in the sealing ring 12. The locking ring 10 is used to be inserted into the inner edge of the third center hole of the supporting column 83 and bent upward to form a locking ring extension 1001, which is tightly fitted outside the supporting column 83, and the bearing 85 is sandwiched between the locking ring extension 1001 and the bearing seat 81.

When rotating, the umbrella column 1 rotates on the supporting column 83 through the upper and lower positioning blocks and the bearing seat 81, which makes the rotation more stable. When locking is needed, the wrench 9 is pulled, and the wrench 9 drives the positioning pin 11 to be inserted into the locking groove 1000 of the locking ring 10, so that the bearing seat 81 and the umbrella column 1 can no longer rotate around the supporting column 83.

A hand-operated rope wheel is provided on the umbrella column 1, and the hand-operated rope wheel is connected to the umbrella tray through a rope to drive the lower umbrella tray to move up and down on the connecting column, and then drive the umbrella cover to unfold or fold. The structure and principle of umbrella tray assembly and hand-operated rope pulley are publicly known technologies and have been widely used in the field of parasols.

After the umbrella body is opened, the position of the armrest shell can be adjusted under the umbrella cover, and the angle of the umbrella cover of the Roman umbrella can be adjusted by moving the armrest shell up and down. By pressing the trigger, the Roman umbrella can be locked or unlocked quickly, which is convenient for the adjustment of the armrest shell. After locking, the thimble tightly abuts against the chute, which has strong connection stability. And rollers convenient for sliding are provided on both sides of the embedded strip of the armrest shell.

Finally, it should be noted that the above embodiments are only used to illustrate the technical schemes of the present invention, but not to limit them. Although the present invention has been described in detail with reference to the foregoing embodiments, those of ordinary skill in the art should understand that the technical schemes described in the foregoing embodiments can still be modified, or some or all of the technical features can be equivalently substituted. However, these modifications or substitutions do not make the essence of the corresponding technical schemes deviate from the scope of the technical schemes of embodiments of the present invention.

What is claimed is:

1. An umbrella having an independent handle mechanism, the umbrella comprising an umbrella column, wherein a top portion of the umbrella column is hinged with one end of a connecting rod, and the other end of the connecting rod is hinged with a pull rod, one side of the umbrella column is provided with a chute, an armrest shell is slidably fitted in the chute, one end of the pull rod is hingedly fitted with an upper umbrella tray, and the other end of the pull rod is fixedly connected to a handle base; the handle base comprises a pull rod receiving end and a rope reel mounting end, a rope reel set is fittingly mounted in the rope reel mounting end; the rope reel set is configured to wind an umbrella rope, and extends into an umbrella tray assembly along the pull rod, so as to realize opening and closing of the umbrella tray assembly; the handle base is hingedly fitted with the armrest shell, the armrest shell is located at an inner side of the umbrella column and is provided for fitting with the chute in an inner side wall of the umbrella column; and the armrest shell is vertically movably positioned along the chute, wherein the rope reel set is provided with a first rope guide roller and a second rope guide roller, the first rope guide roller and the second rope guide roller are located at or near both ends of the pull rod, and the umbrella rope extends from the rope reel set to the first rope guide roller and the second rope guide roller sequentially, and extends outward into the umbrella tray assembly through an umbrella rope outlet; and wherein an end portion of the pull rod is provided with a rope guide roller end seat, and a bolt piece and the second rope guide roller pass through the rope guide roller end seat.

2. The umbrella having an independent handle mechanism according to claim 1, wherein the umbrella rope extends along an inner cavity of the pull rod to the umbrella tray assembly.

3. The umbrella having an independent handle mechanism according to claim 1, wherein rope holes are provided above both ends of the pull rod, and a rope slot is provided at a top portion of the pull rod; after the umbrella rope passes through the rope hole, the umbrella rope extends through the rope slot to an end rope hole connected to the umbrella tray, and extends into the umbrella tray assembly through the second rope guide roller.

4. The umbrella having an independent handle mechanism according to claim 1, wherein an end portion of the pull rod is embedded into an inner end of the pull rod receiving end, and is fixedly mounted by a bolt piece; and the first rope guide roller is rotatably mounted on the bolt piece.

5. The umbrella having an independent handle mechanism according to claim 1, wherein an inner end of the rope reel mounting end is provided with a rope reel, and the rope reel is connected to the armrest shell through a rotating shaft.

6. The umbrella having an independent handle mechanism according to claim 1, wherein the armrest shell is provided with a trigger, and a lower end of the trigger is provided with a thimble for fitting.

7. The umbrella having an independent handle mechanism according to claim 6, wherein an upper end of the trigger is provided with a clamping piece, and the clamping piece is connected to a fixing pin provided on the armrest shell.

* * * * *